US007591103B2

(12) United States Patent
Tremble et al.

(10) Patent No.: US 7,591,103 B2
(45) Date of Patent: Sep. 22, 2009

(54) WINDOW SASH TILT LATCH

(75) Inventors: John Tremble, Redmond, WA (US); John Falcon, Langley (CA); Kai Zhang, Langley (CA)

(73) Assignee: Milgrad Manufacturing, Inc., Tacoma, WA (US)

( * ) Notice: Subject to any disclaimer, the term of this patent is extended or adjusted under 35 U.S.C. 154(b) by 712 days.

(21) Appl. No.: 11/300,882

(22) Filed: Dec. 15, 2005

(65) Prior Publication Data

US 2007/0137109 A1 Jun. 21, 2007

(51) Int. Cl.
*E05D 15/22* (2006.01)

(52) U.S. Cl. ..... 49/185; 49/183; 49/445; 292/DIG. 47

(58) Field of Classification Search ..... 49/180, 49/181, 183, 185, 445, 446; 292/175, 337, 292/DIG. 47
See application file for complete search history.

(56) References Cited

U.S. PATENT DOCUMENTS

| | | | | |
|---|---|---|---|---|
| 318,871 | A * | 5/1885 | Clark | 49/421 |
| 1,783,150 | A | 11/1930 | Jeffery | |
| 3,075,256 | A | 1/1963 | Nofziger | |
| 4,482,178 | A * | 11/1984 | Damiana | 292/175 |
| 4,887,389 | A | 12/1989 | Haltof | |
| 5,139,291 | A | 8/1992 | Schultz | |
| 5,301,989 | A | 4/1994 | Dallmann et al. | |
| 5,618,067 | A | 4/1997 | Carlson et al. | |
| 5,669,639 | A | 9/1997 | Lawrence | |
| 5,671,958 | A | 9/1997 | Szapucki et al. | |
| D411,095 | S | 6/1999 | Schultz | |
| 5,970,656 | A | 10/1999 | Maier | |
| D416,780 | S | 11/1999 | Schultz | |
| 5,996,283 | A | 12/1999 | Maier | |
| 6,021,603 | A | 2/2000 | Prete et al. | |
| 6,155,615 | A | 12/2000 | Schultz | |
| 6,178,696 | B1 | 1/2001 | Liang | |
| 6,183,024 | B1 | 2/2001 | Schultz et al. | |
| D442,847 | S | 5/2001 | Schultz et al. | |
| 6,230,443 | B1 * | 5/2001 | Schultz | 49/183 |
| D444,373 | S | 7/2001 | Schultz et al. | |
| 6,485,070 | B1 | 11/2002 | Schultz | |
| RE37,916 | E | 12/2002 | Szapucki et al. | |
| 6,604,324 | B1 | 8/2003 | Maier | |
| 6,722,712 | B2 | 4/2004 | Schultz | |
| 6,874,826 | B1 | 4/2005 | Polowinczak et al. | |
| 6,883,272 | B2 | 4/2005 | Maier | |
| 2002/0093205 | A1 | 7/2002 | Schultz | |
| 2003/0047948 | A1 | 3/2003 | Polowinczak et al. | |
| 2004/0031202 | A1 | 2/2004 | Maier | |
| 2004/0128916 | A1 | 7/2004 | Fullick | |
| 2004/0168369 | A1 | 9/2004 | Heng et al. | |

FOREIGN PATENT DOCUMENTS

| | | |
|---|---|---|
| WO | WO 2004/099541 | 11/2004 |

* cited by examiner

*Primary Examiner*—Gregory J. Strimbu
(74) *Attorney, Agent, or Firm*—Reising Ethington PC

(57) ABSTRACT

A window sash assembly includes a window sash having an upper rail and at least one side rail that form a corner of the window sash. A slot at the window sash corner opens laterally outwardly from the corner and is defined in part by opposed linear tracks on the upper rail. A tilt latch is disposed in the slot, and includes a housing having opposed sidewalls and outwardly extending ledges overlying the sidewalls slidably received over the tracks on the upper rail. A flexible resilient spring element on each sidewall is spaced from the associated ledge such that the tracks on the rails are slidably received between the ledges and the spring elements.

6 Claims, 3 Drawing Sheets

WINDOW SASH TILT LATCH

The present disclosure relates to a window sash assembly that includes a window sash and a tilt latch at a corner of the window sash, and to a tilt latch for such an assembly.

BACKGROUND AND SUMMARY OF THE DISCLOSURE

In windows for various applications such as home applications, it is desirable to provide the moveable sash or sashes with tilt latches at opposed sides of the sash. These tilt latches permit the sash to be tilted away from the window frame to facilitate cleaning for example. The tilt latch typically is positioned in a slot at a corner of the sash frame. An objective of the present disclosure is to provide a window sash assembly, and a tilt latch for a window sash assembly, in which the tilt latch is constructed to minimize movement of the latch housing with respect to the sash frame after the latch has been assembled to the frame.

The present disclosure embodies a number of aspects that can be implemented separately from or in combination with each other.

A window sash assembly in accordance with an aspect of the present disclosure includes a window sash having an upper rail and at least one side rail that form a corner of the window sash. A slot at the window sash corner opens laterally outwardly from the corner and is defined in part by opposed linear tracks on the upper rail. A tilt latch is disposed in the slot, and includes a housing having opposed sidewalls and outwardly extending ledges overlying the sidewalls slidably received over the tracks on the upper rail. A flexible resilient spring element on each sidewall is spaced from the associated ledge such that the tracks on the rails are slidably received between the ledges and the spring elements. The spring elements preferably comprise at least one arcuate spring, most preferably a plurality of arcuate springs, on each sidewall of the housing with concave portions opposed to the ledge. The housing preferably is of molded plastic construction, and the arcuate springs preferably are integrally molded with the housing.

A window sash assembly in accordance with another aspect of the present disclosure includes a window sash having an upper rail and at least one side rail that form a corner of the window sash. A slot at the corner of the window sash opens laterally outwardly from the corner, and is defined in part by an edge of the side rail. A tilt latch is disposed in the slot and includes a housing having a retainer with a stepped profile in engagement with the edge of the side rail to retard removal of the latch from the slot.

BRIEF DESCRIPTION OF THE DRAWINGS

The disclosure, together with additional objects, features advantages and aspects thereof, will best be understood from the following description, the appended claims and the accompanying drawings, in which:

DETAILED DESCRIPTION OF PREFERRED EMBODIMENTS

Figure 1:
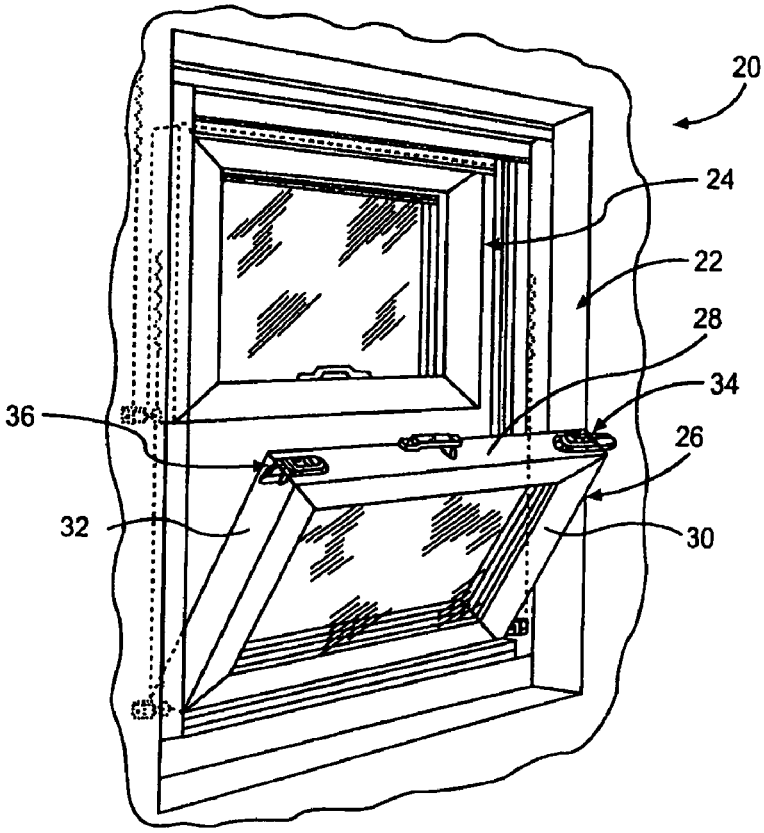
FIG. 1 is a perspective view of a window having a sash in accordance with an exemplary embodiment of the disclosure.
Figure 2:
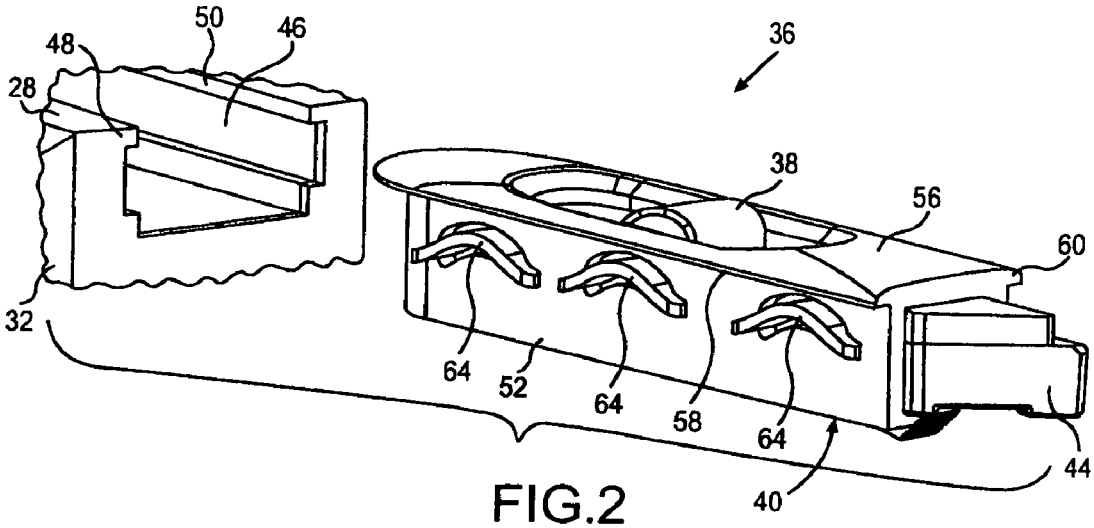
FIG. 2 is a fragmentary exploded perspective view of a corner of the window sash in FIG. 1.
Figure 3:
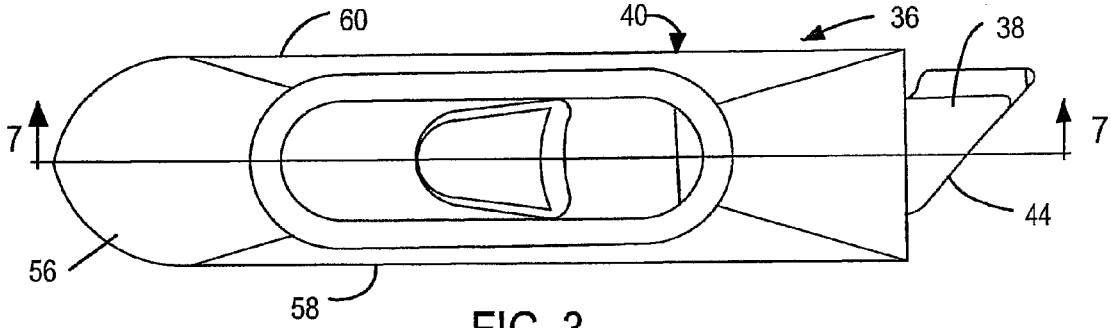
FIG. 3 is a top plan view of the tilt latch in FIG. 2.
Figure 4:
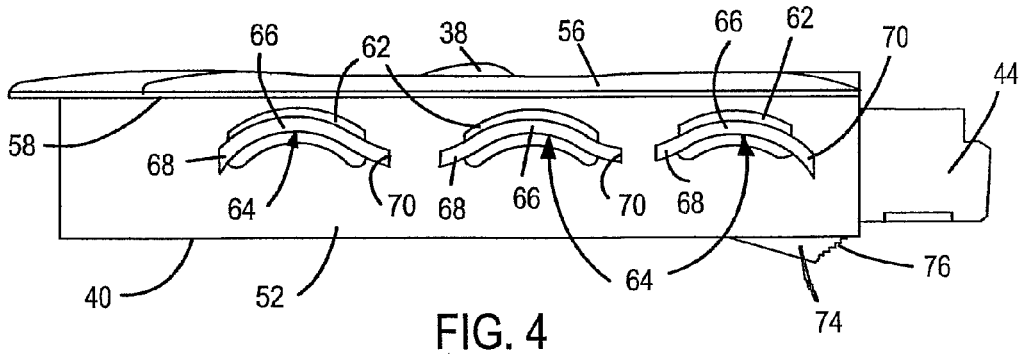
FIG. 4 is a side elevational view of the tilt latch in FIG. 3.
Figure 5:
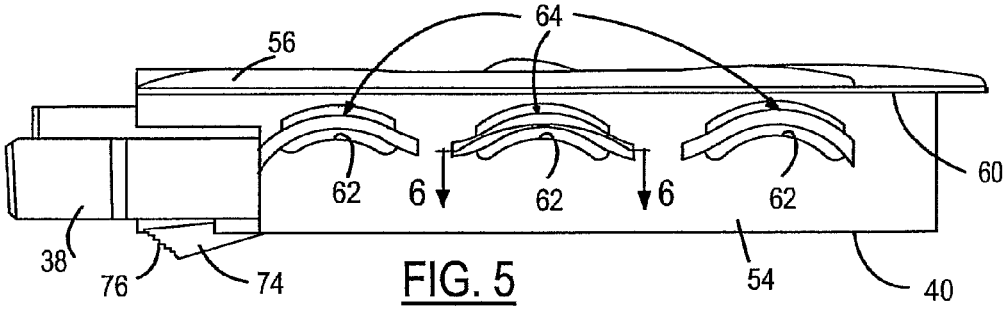
FIG. 5 is an opposing side elevational view of the tilt latch in FIG. 3.
Figure 6:
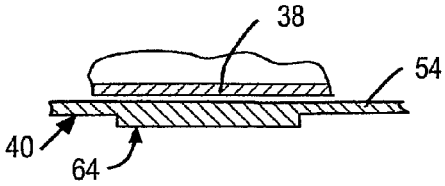
FIG. 6 is a fragmentary sectional view taken substantially along the line 6-6 in FIG. 5.

FIG. 1 illustrates a building window 20 that includes a generally rectangular outer frame 22, and an upper sash 24 and a lower sash 26 disposed within frame 22. Window 20 illustrated in FIG. 1 is a so-called double-hung window in which both upper sash 24 and lower sash 26 are mounted for movement within outer frame 22. However, the subject matter of the present disclosure is equally useful in a window assembly in which only one sash 26 is moveable. Sash 26 includes an upper rail 28 and a pair of side rails 30,32. A tilt latch 34,36 is positioned at each corner of upper rail 28 with respective side rails 30,32. Tilt latches 34,36 are mirror images of each other, and tilt latch 36 will be described in detail in conjunction with FIGS. 2-8.

Figure 7:
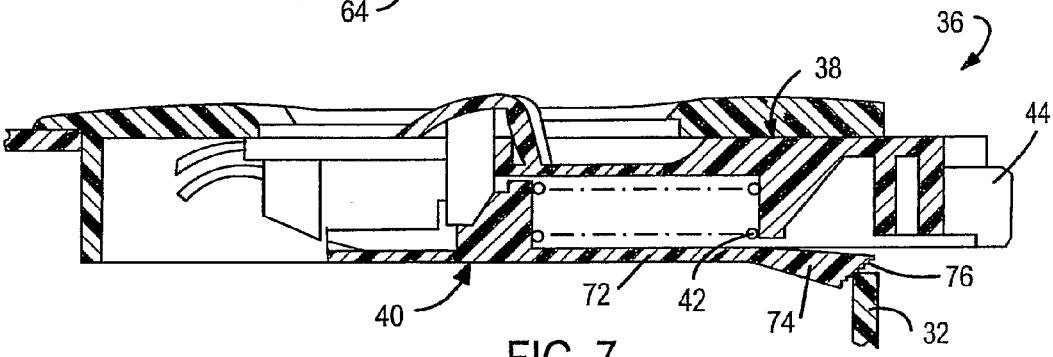
FIG. 7 is a fragmentary sectional view taken substantially along the line 7-7 in FIG. 3.
Figure 8:
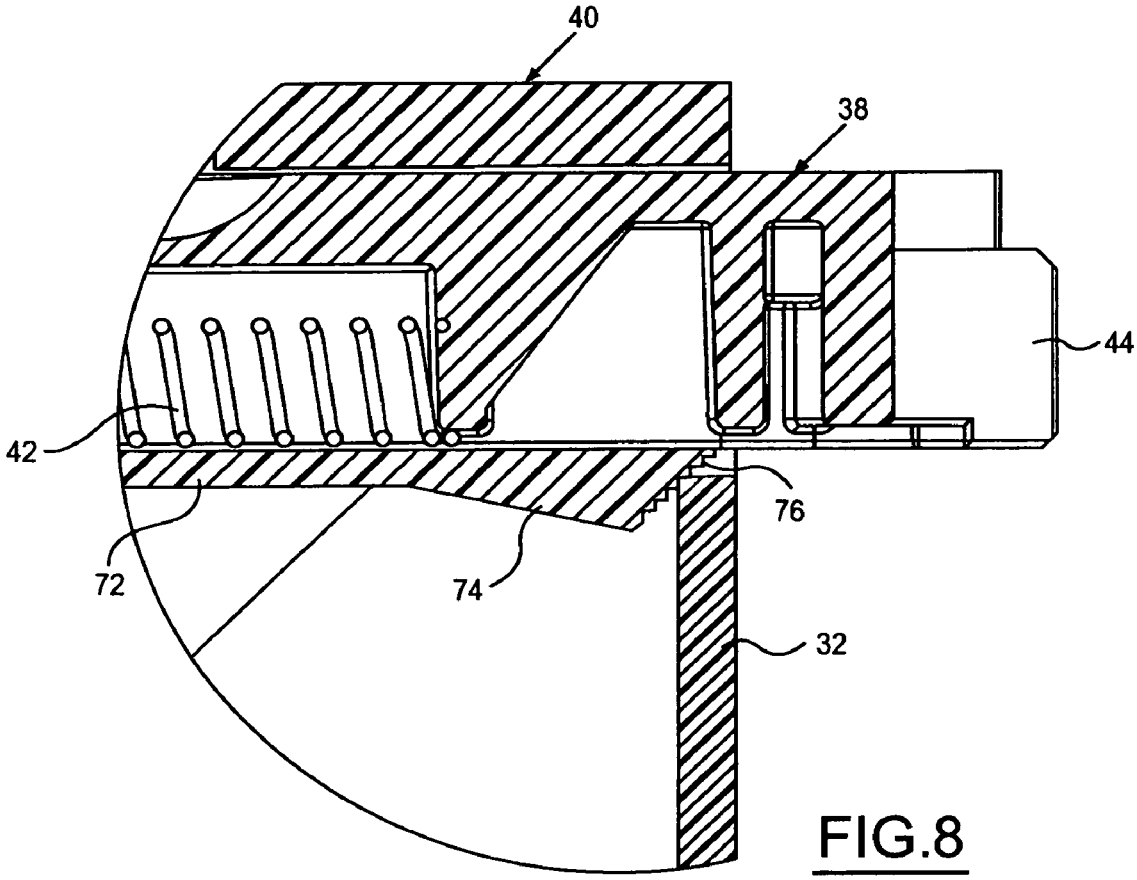
FIG. 8 is a fragmentary sectional view on an enlarged scale of a portion of FIG. 7.

Referring to FIG. 7 in particular, tilt latch 36 includes a latch bolt 38 slidably carried within a housing 40 and urged laterally outwardly (with respect to sash 26) by a spring 42 captured between latch bolt 38 and housing 40. Latch bolt 38 preferably has a beveled outer end or nose 44 that engages frame 22 (FIG. 1) to urge the latch bolts laterally inwardly as sash 26 is swung from the open position of FIG. 1 toward the closed position. Latch 36 is received within a laterally extending slot 46 (FIG. 2) formed at the corner of upper sash rail 28 and side rail 32. Slot 46 includes a pair of longitudinally extending tracks 48,50 that are opposed to each other across slot 46. Tracks 48 are formed in the contour of rail 28, which preferably is of extruded metal or plastic construction. An identical slot is formed at the opposing end of rail 28 for receipt of tilt latch 34 (FIG. 1) as previously described.

Tilt latch housing 40 preferably is of elongate generally rectangular construction, having a pair of laterally opposed parallel sidewalls 52,54 and a top panel 56. The spaced edges of top panel 56 form ledges 58,60 that overlie or overhang sidewalls 52,54 respectively. Each sidewall 52,54 has a series of longitudinally spaced arcuate openings 62 (FIGS. 2 and 4-5) adjacent to but preferably spaced from associated ledges 58,60. A flexible resilient continuously curvilinear arcuate spring 64 is integrally molded with housing 40 within each arcuate opening 62. Each arcuate spring 64 includes an upwardly convex mid portion 66 adjacent to but spaced from the associated ledge 58,60, and end portions 68,70 that are molded integrally with the associated housing sidewall 52,54. Thus, the end portions 68,70 of springs 64 are fixed with respect to sidewalls 52,54 while the mid portion 66 of each spring 64 is free to flex within its associated opening 62. The mid portions 66 of arcuate springs 64 preferably are uniformly spaced from the associated overlying ledge 58,60. Thus, when latch 36 is slid into slot 46 in FIG. 2, the opposed tracks 48,50 of slot 46 are received between ledges 58,60 and underlying springs 64. Ledges 58,60 slide along the top surfaces of tracks 48,50 while the mid portions 66 of springs 64 engage and slide along the bottom surfaces or undersurfaces of tracks 48,50. The resiliency of arcuate springs 64 accommodates tolerance variations in tracks 48,50 and in the molding of housing 40, and help retain latch 36 tightly within slot 46.

A resilient retainer 72 is integrally molded with housing 40. The head or end 74 of retainer 72 engages the upper inside edge of side rail 32 that forms slot 46. Head 74 has a free end with a stepped or staircase-shaped profile 76 best seen in FIGS. 7 and 8. The purpose of this stepped profile is to provide multiple steps for engagement with the opposing edge of rail 32. The stepped profile at the end of retainer 72 accommodates tolerance variations in the thickness of rail 32 and in the depth of slot 46 in rail 28. Housing 40 preferably is of molded plastic construction, and springs 64 (or 64*a* in FIG. 9) are integrally molded with the housing.

Figure 9:
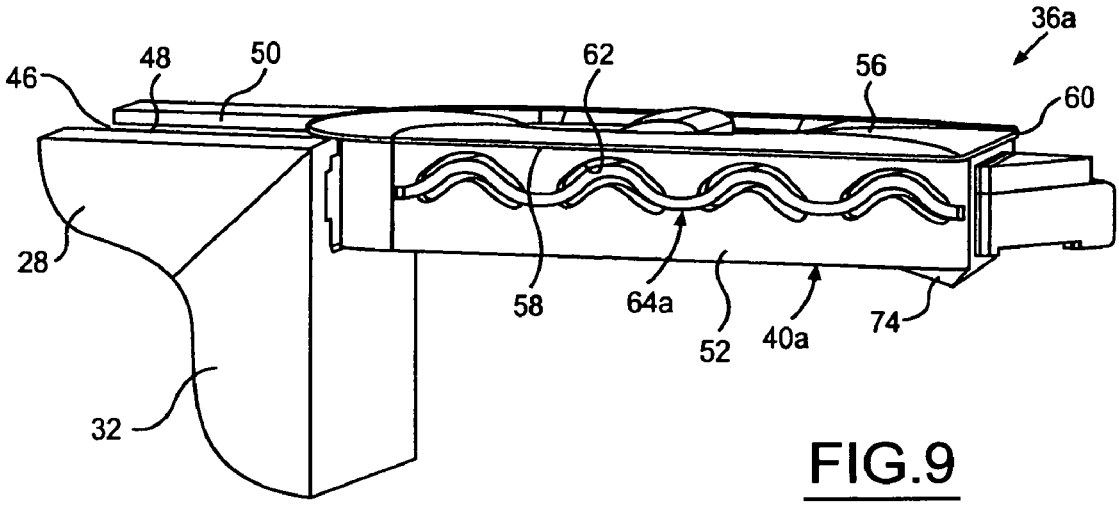
FIG. 9 is a fragmentary exploded perspective view of a modification to the tilt latch in FIG. 2.

FIG. 9 illustrates a latch 36*a* that is similar to latch 36 in FIGS. 2-8 except that the arcuate springs in latch 36*a* are contiguous with each other and form an elongated flexible resilient wavy spring 64*a* on each side of the latch housing. Each wavy spring 64*a* has upper reaches adjacent to ledges 58,60, and are flexibly and resiliently disposed within associated arcuate openings in the sidewalls of the housing. The lower reaches of spring 64*a* are integrally molded with the housing sidewall.

There thus has been disclosed a window sash assembly and a tilt latch for a window sash assembly that fully satisfy all of the objects and aims previously set forth. The disclosure has been presented in conjunction with several exemplary embodiments, and a number of modifications and variations have been discussed. Other modifications and variations readily will suggest themselves to persons of ordinary skill in the art in view of the foregoing description. The disclosure is intended to embrace all such modifications and variations as fall within the spirit and broad scope of the appended claims.

The invention claimed is:

1. A window sash assembly that includes:

a window sash having an upper rail and at least one side rail that form a corner of said window sash, a slot in said corner opening laterally outwardly from said corner, said slot being defined in part by opposed linear tracks on said upper rail, and a tilt latch disposed in said slot, said tilt latch including an elongated housing of molded plastic construction having opposed sidewalls and outwardly extending ledges extending outwardly beyond said sidewalls, and having elongated flexible resilient springs extending outwardly from said sidewalls of said housing, said tracks being received between said ledges and said springs, said housing having arcuate openings in said sidewalls, and said springs partially extending into said arcuate openings and being molded integrally with said housing sidewalls at opposed ends of each of said springs, wherein each said spring is continuously curvilinear between said opposed ends.

2. The assembly set forth in claim 1 wherein said slot is formed in part by an edge of said side rail, and wherein said housing includes a retainer for engagement with said edge to retard removal of said housing from said slot.

3. The assembly set forth in claim 2 wherein said retainer has an end with a stepped profile engaging said edge.

4. The assembly set forth in claim 1 wherein said springs are opposed to said ledges and uniformly spaced from said ledges.

5. A tilt latch for receipt in a window sash frame having a laterally opening slot with parallel tracks and an edge, said tilt latch including:

a rectangular housing having opposed sidewalls and a top panel, said top panel having ledges extending outwardly beyond said sidewalls, a plurality of longitudinally spaced upwardly convex arcuate openings in each of said sidewalls, and an elongated flexible resilient springs extending outwardly from said sidewalls of said housing, each of said springs having spaced ends integrally molded with a respective one of said sidewalls of said housing and a mid portion disposed within a respective one of said arcuate openings, each of said springs being continuously curvilinear between said spaced ends.

6. The tilt latch set forth in claim 5 including a retainer resiliently coupled to said housing and having an end with a stepped profile for engagement with said edge.

* * * * *